United States Patent [19]

Crotwell

[11] Patent Number: 4,651,830

[45] Date of Patent: Mar. 24, 1987

[54] MARINE WELLHEAD STRUCTURE

[75] Inventor: Gerald W. Crotwell, Sugar Land, Tex.

[73] Assignee: Cameron Iron Works, Inc., Houston, Tex.

[21] Appl. No.: 751,574

[22] Filed: Jul. 3, 1985

[51] Int. Cl.[4] ..... F21B 33/043

[52] U.S. Cl. ..... 166/338; 166/368; 166/217; 185/18; 185/141

[58] Field of Search ..... 166/338, 339, 344, 348, 166/347, 368, 382, 383, 217; 285/3, 4, 18, 141, 315, 321

[56] References Cited

U.S. PATENT DOCUMENTS

| | | | |
|---|---|---|---|
| 3,704,033 | 11/1972 | Arnold | 166/344 X |
| 4,012,059 | 3/1977 | Luke et al. | 285/18 |
| 4,216,835 | 8/1980 | Nelson | 166/338 X |
| 4,408,783 | 10/1983 | Gruller | 285/3 |
| 4,441,740 | 4/1984 | Cowan et al. | 285/315 X |

FOREIGN PATENT DOCUMENTS

| | | | |
|---|---|---|---|
| 0945375 | 7/1982 | U.S.S.R. | 166/344 |

*Primary Examiner*—Stephen J. Novosad

*Assistant Examiner*—David J. Bagnell

*Attorney, Agent, or Firm*—Vinson & Elkins

[57] ABSTRACT

The present invention relates to an improved subsea wellhead structure which includes a conductor casing having an internal upwardly facing shoulder, and an internal groove above the shoulder, an external groove, a wellhead housing having an external downwardly facing shoulder adapted to seat on the casing shoulder, an external shoulder above the seat shoulder which tapers upwardly and outwardly at a slight angle, such as, for example, five degrees, a split latching and loading ring surrounding said housing and seated on said tapered external shoulder, a cam ring above the split ring, means for releasably retaining the cam ring in its inactive position and actuating means for moving the cam ring into position wedging the split ring outwardly on the tapered shoulder into tight load transmitting position within the internal casing groove and the tapered shoulder. This loading of split ring 50 and shoulders 42 and 32 of housing 40 and conductor casing 28 cause cyclic external loads on the upper portion of wellhead housing to be transferred into conductor casing and to insulate the smaller casings from such loading.

4 Claims, 3 Drawing Figures

MARINE WELLHEAD STRUCTURE

BACKGROUND

Subsea wellheads normally have a large diameter conductor casing, such as a thirty inch casing, on which a housing is supported which housing extends upwardly and downwardly from the wellhead and is supported from the conductor casing. In low pressure drilling structures or high pressure production risers, external cyclic loads are imparted to the wellhead housing. It is preferred to transmit these cyclic loads from the wellhead housing to the conductor casing. When such cyclic loads are allowed to enter the smaller casing connected to the wellhead housing, fatigue in the smaller casing may result.

In prior structures large external bending loads are usually reacted through a force couple system created when the wellhead housing and a smaller casing (20") move relative to the conductor casing until contact is made. The force couple system is sometimes accomplished using bosses located on the wellhead housing and heavy wall extension that contact the conductor housing (large casing 30") when relative movement occurs. These bosses, however, require radical clearance to enable the wellhead housing to be run inside the conductor housing. The radial clearance between components allows the smaller casing to react those cyclic loads insufficient to move the wellhead housing enough to create the force couple. Reacting these loads in the smaller casing could result in fatigue of the smaller casing.

Also prior axial attachment of the wellhead housing and conductor casing is accomplished by one component carrying spring loaded latching segments, pins or a split ring that engage in a mating groove on the other component (e.g., U.S. Pat. Nos. 3,468,558 and 3,871,449). These attachment mechanisms, due to design clearances, allow axial movement of the wellhead housing. Axial movement of the wellhead housing could result in some load transfer mechanism, such as moment bosses or double angle tapers, to be disengaged when the smaller casing is cemented. Having the load transfer mechanism between the wellhead housing and conductor casing disengaged could create a fatigue problem in the smaller casing.

SUMMARY

The present invention relates to an improved subsea wellhead structure which includes a conductor casing positioned in a well bore with an internal upwardly facing shoulder, an internal latching groove above the shoulder, and an external groove; a housing having an external downwardly facing shoulder supported on the casing shoulder, a first external groove above said housing shoulder with a lower surface tapering slightly upwardly and outwardly, and a second external housing groove above said first housing groove, said first housing groove opening to said latching groove; a split latching and loading ring within said first housing groove and having an internal surface tapering upwardly and outwardly; a cam ring having an external surface tapering upwardly and outwardly to mate with the internal tapered surface of said latching and loading ring; means for moving said cam ring behind said latching and loading ring to force it outward into said internal latching groove with said lower tapered surface on said first external housing groove forcing said latching and loading ring into tight load transmitting engagement between said housing and said conductor casing; and means coacting between said cam ring and said second external housing groove to retain said latching and loading ring in latched and loaded position partly in both of said first external housing groove and said casing internal latching groove.

An object of the present invention is to provide an improved subsea wellhead structure which transmits external cyclic loading from the wellhead housing to the conductor casing.

Another object is to provide an improved subsea wellhead structure with a preloaded connection between the wellhead housing and the conductor casing to minimize transmission of external cyclic loads on the housing to the smaller diameter casing.

A further object is to provide an improved subsea wellhead structure which minimizes fatigue problems in the smaller casing as a result of the external cyclic loads experienced by the wellhead casing.

BRIEF DESCRIPTION OF THE DRAWINGS

These and other objects and advantages are hereinafter set forth and explained with respect to the drawings wherein.

DESCRIPTION OF THE PREFERRED EMBODIMENT

Figure 1:
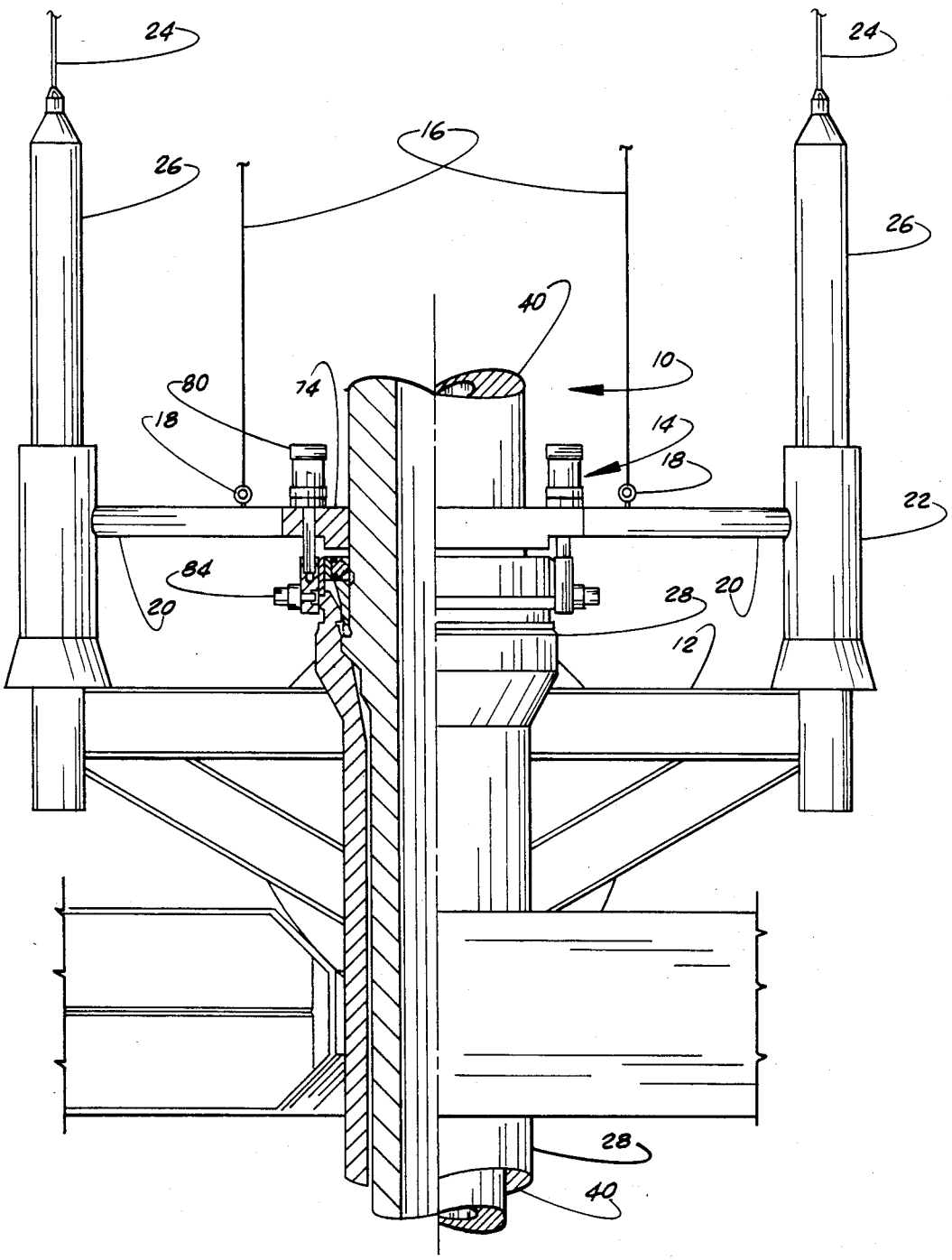
FIG. 1 is an elevation view of the improved subsea wellhead structure of the present invention.

Improved subsea wellhead structure 10 of the present invention is in position at the bottom of the body of water and is supported by landing platform 12 and actuating means 14 is lowered on tugger lines 16 extending upwardly from eyes 18 on arms 20 of guide structure 22. With structure 10 supported as shown on guide structure 22 it is lowered over guide lines 24 and is landed on guide posts 26 as shown.

Figure 2:
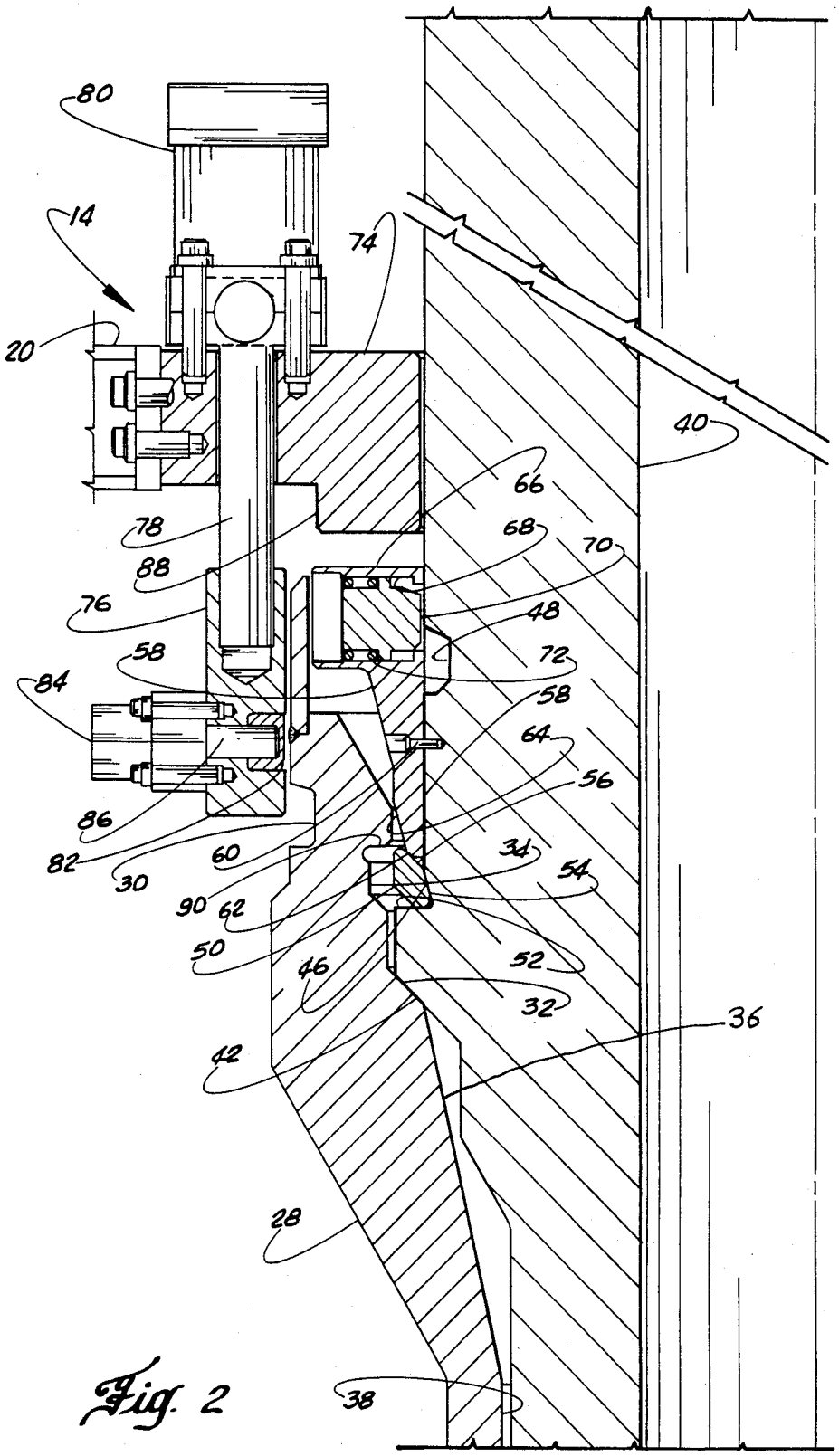
FIG. 2 is a partial section view through the improved structure prior to the latching and loading connection being made.
Figure 3:
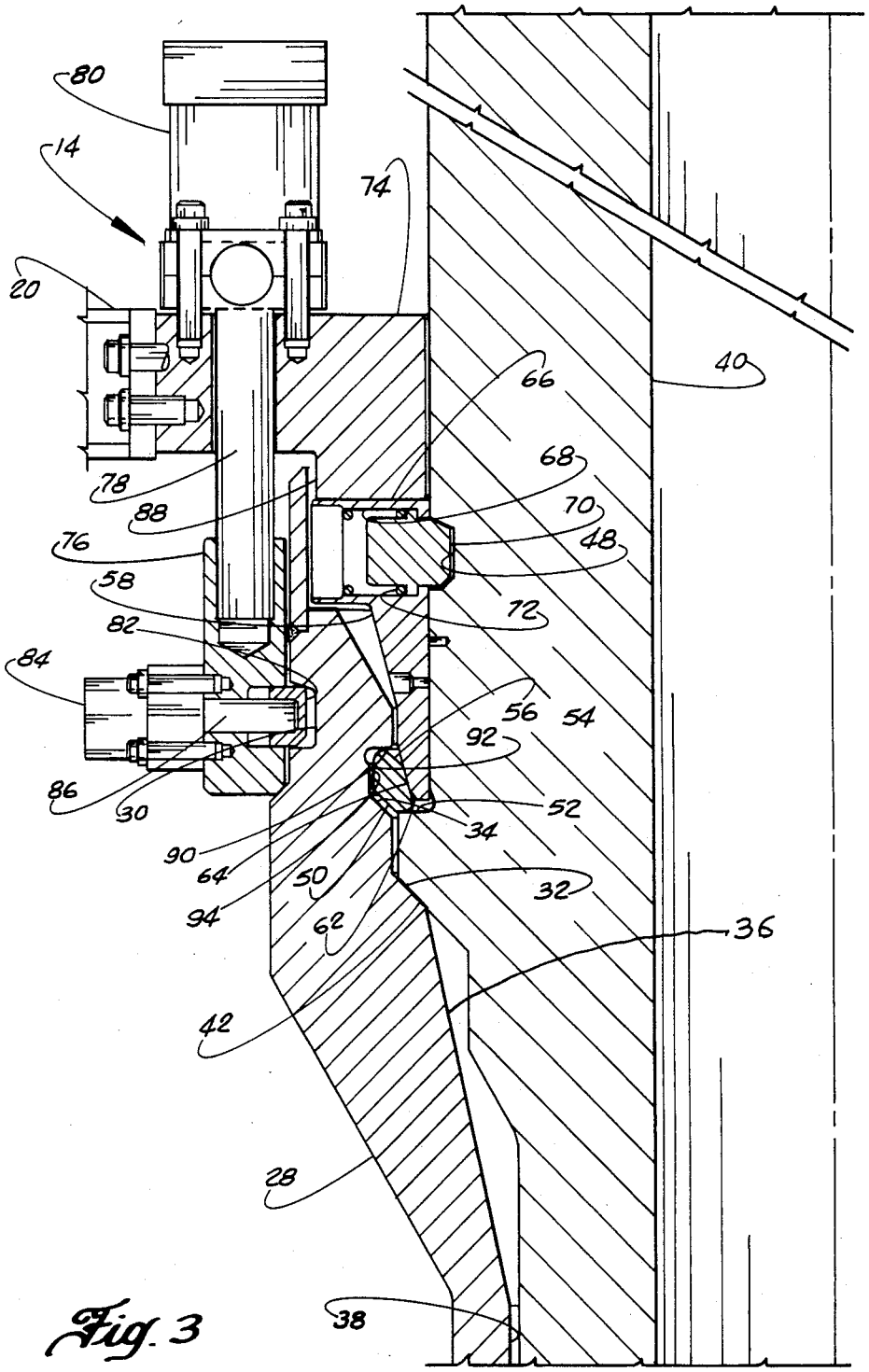
FIG. 3 is another similar partial sectional view showing the completion of the latching and loading connection.

The details of subsea wellhead structure 10 is more completely shown in FIGS. 2 and 3. Subsea wellhead structure 10 includes conductor casing 28 which has external groove 30, internal upwardly facing shoulder 32, internal groove 34 above shoulder 32 and internal tapered surface 36 which tapers downwardly and inwardly to internal bore 38 of casing 28. Normally, conductor casing 28 is the large diameter casing, such as a thirty inch casing, of the wellhead. Structure 10 also includes wellhead housing 40 with it external downwardly facing shoulder 42 which is adapted to seat on shoulder 32 of conductor casing 28, external groove 46 which faces and registers with internal groove 34 in conductor casing 28 and upper external groove 48 above groove 46. Split latching and loading ring 50 is positioned on shoulder 52 which forms the lower surface of groove 46 and is tapered upwardly and outwardly at a slight angle, for example, an angle of approximately five degrees with respect to horizontal. Ring 50 includes internal tapered surface 54 and upper tapered surface 56. Cam ring 58 surrounds housing 40 and in running position is releasably secured thereto by suitable means, such as shear pins 60. Lower external surface 62 is tapered to engage and mate with tapered surface 56 and the exterior of cam ring 58 above surface 62 is tapered surface 64 which mate with and functions to cam split ring 50 when cam ring 58 is moved downwardly within split ring 50 as shown in FIG. 3. Upper surface 66 of cam ring 58 is exposed for suitable engagement of actuating means 14 as hereinafter described. Immediately below upper surface 66 is a plurality of bores 68 extend radially through cam ring 58 and pins 70 extend therefrom and are biased inwardly by springs 72.

Actuating means 14 is provided to move cam ring 58 into position wedging split ring 50 into its latched and loaded position as shown in FIG. 3. Actuating means 14 includes structural ring 74, from which arms 20 extend, locking ring 76 which is supported from ring 74 by rods 78 of pistons 80 and locking segments 82 which are actuated by pistons 84 and are connected to the inner end of piston rods 86. When actuating means 14 is lowered into position surrounding conductor casing 28 and wellhead housing 40 as shown in FIG. 2 it is lowered downward until locking segments 82 engage within external groove 30 of conductor casing 28. In this position actuating means 14 is locked in position and ready to actuate cam ring 58. Annular depending projection 88 of structural ring 76 engages upper surface 66 of cam ring 58. The energization of pistons 80 moves ring 74 downward by retracting their rods 78. This downward movement is sufficient to move cam ring 58 into its wedging position. Also, sufficient force is developed to shear pins 60.

The wedging of split ring 50 outwardly by cam ring 58 also causes a wedging of ring 50 between surface 52 which tapers upwardly in the outward direction and upper shoulder 90 of groove 34. Also, the downward facing shoulder 42 of wellhead housing 40 is brought into tight engagement with the upward facing shoulder 32 of conductor casing 28. Split ring 50 is in tight engagement between shoulders 52 and 90 and shoulder 42 of well housing 40 engages shoulder 32 of conductor casing 28.

In this position the cyclic loading on the upper end of wellhead housing 40 is transmitted through split ring 50 into the upper end of conductor casing 28 and through shoulder 42 of wellhead housing 40 into shoulder 32 of conductor casing 28 so that the smaller casing members are isolated from such cyclic loading to protect them from possible fatigue failure.

What is claimed is:

1. A subsea wellhead comprising a conductor casing positioned in the well bore and having an internal upwardly facing shoulder, and an internal latching groove above said shoulder, a housing having an external downwardly facing shoulder supported on said casing shoulder, a first external groove above said housing shoulder with a lower surface tapering slightly upwardly and outwardly, said first housing groove opening to said latching groove, a second external groove spaced above said first groove, a split latching and loading ring within said first housing groove and having an internal surface tapering upwardly and outwardly, a cam ring having an external surface tapering upwardly and outwardly to mate with the internal tapered surface of said latching and loading ring, actuating means coacting with said cam ring to move said cam ring behind said latching and loading ring to ensure transfer of loads from the upper portion to said housing through said latching and loading ring into said conductor casing, and lock means carried by said cam ring to engage in said second external housing groove to latch said cam ring behind said latching and loading ring to retain said latching and loading ring in engagement with the internal latching groove in the conductor casing.

2. A subsea wellhead according to claim 1 wherein said cam ring has its upper surface exposed on the exterior of said housing to be engaged by said actuating means for moving said latching and loading ring into its latched and load transfer position.

3. A subsea wellhead structure comprising a conductor casing positioned in the well bore and having an internal upwardly facing shoulder, and an internal latching groove above said shoulder, a housing having an external downwardly facing shoulder supported on said casing shoulder, a first external groove above said housing shoulder with a lower surface tapering slightly upwardly and outwardly, said first housing groove opening to said latching groove, a split latching and loading ring within said first housing groove and having an internal surface tapering upwardly and outwardly, a cam ring having an external surface tapering upwardly and outwardly to mate with the internal tapered surface of said latching and loading ring, actuating means coacting with said cam ring to move said cam ring behind said latching and loading ring to ensure transfer of loads from the upper portion to said housing through said latching and loading ring into said conductor casing, means coacting between said cam ring and said housing groove to retain said cam ring in set position to retain said latching and loading ring in position partly in both of said first external housing groove and said casing internal latching groove, a second external housing groove above said first housing groove, and wherein said retaining means between said cam ring and said housing includes spring loaded pins connected to said cam ring and adapted to engage within said second external housing groove to retain said cam ring in its set position.

4. A subsea wellhead comprising a conductor casing positioned in the well bore and having an internal upwardly facing shoulder, and an internal latching groove above said shoulder, a housing having an external downwardly facing shoulder supported on said casing shoulder, a first external groove above said housing shoulder with a lower surface tapering slightly upwardly and outwardly, said first housing groove opening to said latching groove, a split latching and loading ring within said first housing groove and having an internal surface tapering upwardly and outwardly, a cam ring having an external surface tapering upwardly and outwardly to mate with the internal tapered surface of said latching and loading ring, actuating means coacting with said cam ring to move said cam ring behind said latching and loading ring to ensure transfer of loads from the upper portion to said housing through said latching and loading ring into said conductor casing, an external groove in said casing wherein said actuating means includes a first piston connected to move a locking segment into said external groove of said conductor casing, and a ring movably supported from said locking segment and engageable with said cam ring to move it into wedging engagement with said latching and loading ring.

* * * * *